US008019101B2

(12) United States Patent
Gorelik et al.

(10) Patent No.: US 8,019,101 B2
(45) Date of Patent: Sep. 13, 2011

(54) CONDENSER MICROPHONE

(75) Inventors: Vladimir Gorelik, Hannover (DE); Eckhard Welker, Wietze (DE); Joerg Riechers, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 885 days.

(21) Appl. No.: 11/853,997

(22) Filed: Sep. 12, 2007

(65) Prior Publication Data

US 2008/0063233 A1 Mar. 13, 2008

(30) Foreign Application Priority Data

Sep. 13, 2006 (DE) ..... 10 2006 042 855

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |
| *H04R 1/00* | (2006.01) |
| *H04R 9/06* | (2006.01) |
| *H04R 11/02* | (2006.01) |

(52) U.S. Cl. ..... 381/174; 381/369; 381/423

(58) Field of Classification Search ..... 381/174, 381/369, 423; 181/153, 158, 171

See application file for complete search history.

(56) References Cited

U.S. PATENT DOCUMENTS

| | | | | |
|---|---|---|---|---|
| 6,078,677 | A * | 6/2000 | Dolleman et al. | 381/418 |
| 7,233,674 | B2 * | 6/2007 | Song | 381/174 |
| 2006/0120544 | A1 | 6/2006 | Akino | |

FOREIGN PATENT DOCUMENTS

| | | | |
|---|---|---|---|
| DE | 72 035 | | 4/1970 |
| DE | 1 939 130 | | 3/1971 |
| DE | 10 2004 024 729 | | 12/2005 |
| DE | 102 97 066 | | 8/2006 |
| EP | 305540 | A1 * | 3/1989 |
| EP | 1 395 084 | | 7/2003 |

* cited by examiner

*Primary Examiner* — Davetta Goins
*Assistant Examiner* — Matthew Eason
(74) *Attorney, Agent, or Firm* — Frommer Lawrence & Haug LLP

(57) ABSTRACT

The present invention is directed to a condenser microphone with a microphone housing cap with a sound inlet opening, a microphone housing with a cross-sectional opening facing the microphone housing cap, and a diaphragm resting along the cross-sectional opening on the front side of the microphone housing surrounding the cross-sectional opening, and a counter-electrode which faces this diaphragm and which is arranged at a short distance from the diaphragm. The invention is further directed to a corresponding method for producing a condenser microphone of this kind. The invention provides an improved condenser microphone and an improved method for producing such a condenser microphone so that the disadvantages of the prior art are overcome while reducing manufacturing-related resources and, therefore, costs at the same time in that the diaphragm of the condenser microphone is glued to the microphone housing in an angle area between the underside of the diaphragm and the outer side of the microphone housing.

15 Claims, 3 Drawing Sheets

CONDENSER MICROPHONE

CROSS-REFERENCE TO RELATED APPLICATION

This application claims priority of German Application No. 10 2006 042 855.2, filed Sep. 13, 2006, the complete disclosure of which is hereby incorporated by reference.

BACKGROUND OF THE INVENTION a) Field of the Invention

The present invention is directed to a condenser microphone with a microphone housing cap with a sound inlet opening, a microphone housing with a cross-sectional opening facing the microphone housing cap, and a diaphragm resting along the cross-sectional opening on the front side of the microphone housing surrounding the cross-sectional opening, and a counter-electrode which faces this diaphragm and which is arranged at a short distance from the diaphragm. The invention is further directed to a corresponding method for producing a condenser microphone of this kind.

b) Description of the Related Art

Every year, several hundred million miniature condenser microphones are produced worldwide. These microphones are generally constructed using stack technology. The individual elements of the transducer, that is, particularly a diaphragm ring with glued on diaphragm, a spacer ring, the counter-electrode, and so on, are simply stacked one on top of the other in the microphone housing. While a construction of this type is especially simple, it also has deficiencies which substantially increase the cost of application for the production of high-quality microphones and particularly high-quality miniature microphones.

First, stacking technology entails relatively high scattering of the electroacoustic parameters. The permissible deviations in sensitivity and frequency response from the reference value and reference curve are usually in the range of ±3 dB or more. Experience has shown that rejects cannot be avoided even with these generous tolerances. Since the results cannot be detected until the capsules are already assembled (generally, flanged), the parts of the defective capsules are no longer usable. The end product is burdened not only by labor costs but also by additional costs in material. One of the most important reasons for the scattering of sensitivity and frequency response is the unevenness of the individual parts. This applies particularly to the inner surface of the microphone housing, of the diaphragm ring and of the electrode surface which serves as the reference surface for the air gap between the diaphragm and the counter-electrode. Mechanical deformation of the diaphragm ring during assembly of the capsule changes the diaphragm stiffness which in turn causes changes in the electroacoustic parameters.

Second, the capsule possesses a very high stray capacitance which is formed by the capacitance between the counter-electrode and the diaphragm ring and between the counter-electrode and the microphone housing. In miniature microphones with very small effective diaphragm surfaces, the stray capacitance causes a loss of 3 to 6 dB in sensitivity.

Third, the spacer ring, which is made of plastic foil, often has a burr. This is the reason why the air gap no longer corresponds to its nominal value.

Fourth, the use of the diaphragm ring leads to a reduction in the oscillating capability of the diaphragm surface. Accordingly, the diaphragm surface in miniature microphones that is capable of oscillating often makes up only half of the cross-sectional area of the capsule, which causes a substantial loss in dynamic range.

DE 10 2004 024 729 A1 discloses a condenser microphone in which the diaphragm is fastened directly to the microphone housing, e.g., in that the diaphragm is arranged between two housing parts of identical diameter and is welded to the outer edge with the housing parts or in that the edge of the diaphragm is folded along an inner housing part and the folded over edge is glued to the inner housing part or clamped to it by means of a ring or an outer housing part. However, the evenness of the diaphragm can be improved over this solution and the expenditure on manufacturing-related resources and material can also be further reduced.

OBJECT AND SUMMARY OF THE INVENTION

It is the primary object of the invention to provide an improved condenser microphone and an improved method for producing such a condenser microphone so that the disadvantages described above are overcome while manufacturing-related resources and, therefore, costs are reduced at the same time.

According to the invention, this object is met in a condenser microphone of the type mentioned above in that the diaphragm is glued to the microphone housing in an angle area between the underside of the diaphragm and the outer side of the microphone housing and by a corresponding method for producing a condenser microphone of this kind.

The invention is based on the insight that this manner of gluing the diaphragm to the microphone housing, so-called microgluing, entirely obviates the need for the customary diaphragm. This offers a number of advantages. In this way, for example, it is possible to make efficient use of almost the entire cross-sectional area of the microphone housing so that the microphone housing and, therefore, the entire microphone can also be built smaller. At the same time, it allows a higher signal-to-noise ratio and improved electroacoustic characteristics to be achieved because the maximum possible diaphragm surface is used and can oscillate freely.

What is more, this arrangement can achieve greater evenness of the diaphragm because there is no gluing of the diaphragm to the front side of the microphone housing. Further, the loss in diaphragm surface capable of oscillating is extremely low (e.g., 0.2 mm in diameter) because the gluing surface is very small. Costs can be reduced at the same time thanks to a reduction in material and time because the diaphragm need not have an edge that is folded over and fastening is easier to carry out. Further, thermal deformations such as occur when the diaphragm is welded are avoided in the manufacture of the microphone. Moreover, improved exposure conditions, e.g., shorter exposure times, are made possible with UV gluing.

The diaphragm is preferably glued to the microphone housing only in the angle area between the underside of the diaphragm and the outer side of the microphone housing. Therefore, gluing can be carried out economically with respect to material and cost.

In another preferred construction, the microphone housing has a bevel at the outer side of the microphone housing in the front and the diaphragm is glued to the microphone housing in the angle area between the underside of the diaphragm and the outer side of the microphone housing formed by the bevel. This has the advantage that the diaphragm can have a smaller diameter and need not project over the outer side of the microphone housing. Further, the adhesive can be used more sparingly in this way because the angle area between the underside of the diaphragm and the outer side of the microphone housing formed by the bevel is smaller than it would be without the bevel. The angle between the outer side formed by the bevel and the front side of the microphone housing is preferably between 15° and 45°. The radial width of the glued portion is preferably in the range of 30 μm to 100 μm.

In order to ensure that the diaphragm makes reliable contact with the microphone housing and has a greater evenness, it is preferable that no adhesive is arranged between the front side of the microphone housing and the diaphragm or an electrically conductive coating arranged at least partially on the diaphragm.

The underside of the diaphragm is preferably glued to the outer side of the microphone housing by means of a highly liquid adhesive, e.g., a one-component, solvent-free, UV-curing, acrylate-based adhesive.

In a preferred method, adhesive is applied only at one point in the angle area between the underside of the diaphragm and the outer side of the microphone housing for gluing the diaphragm to the microphone housing, and the adhesive then distributes itself in the angle area. Accordingly, the condenser microphone can be produced in less time.

Further, the inner diameter of the microphone housing cap and/or of a closing cap is preferably greater than the outer diameter of the microphone housing, and the microphone housing cap is arranged over the microphone housing. In this way, the microphone housing cap and/or the closing cap can easily be connected to the microphone housing by placing it on the latter. For this purpose, the microphone housing preferably has concentrically arranged webs, e.g., strips, on its outer circumference. This prevents the microphone housing cap and/or closing cap from coming loose easily once it has been fitted. The webs can have different cross-sectional shapes, e.g., a rectangular or triangular cross section, and can be arranged in different areas on the outer circumference, e.g., in a zigzag manner or in a helical or screw-thread shape.

Further, a printed circuit board with a circuit arrangement for signal processing is preferably arranged at the microphone housing and is arranged at a distance from the counter-electrode and electrically connected to the counter-electrode by electric connecting means, the distance of the printed circuit board from the counter-electrode being defined by the microphone housing itself. This construction is advantageous above all in technical respects relating to manufacture.

In another construction, the counter-electrode is carried by an insulating part which is not connected to the microphone housing over its full circumferential area, so that at least one gap serving as an air outlet is formed between the edge of the insulating part and the inner wall of the microphone housing. This improves the oscillating capability of the diaphragm at the outer edge.

The invention will be described more fully in the following with reference to the drawings.

DESCRIPTION OF THE PREFERRED EMBODIMENTS

Figure 1:
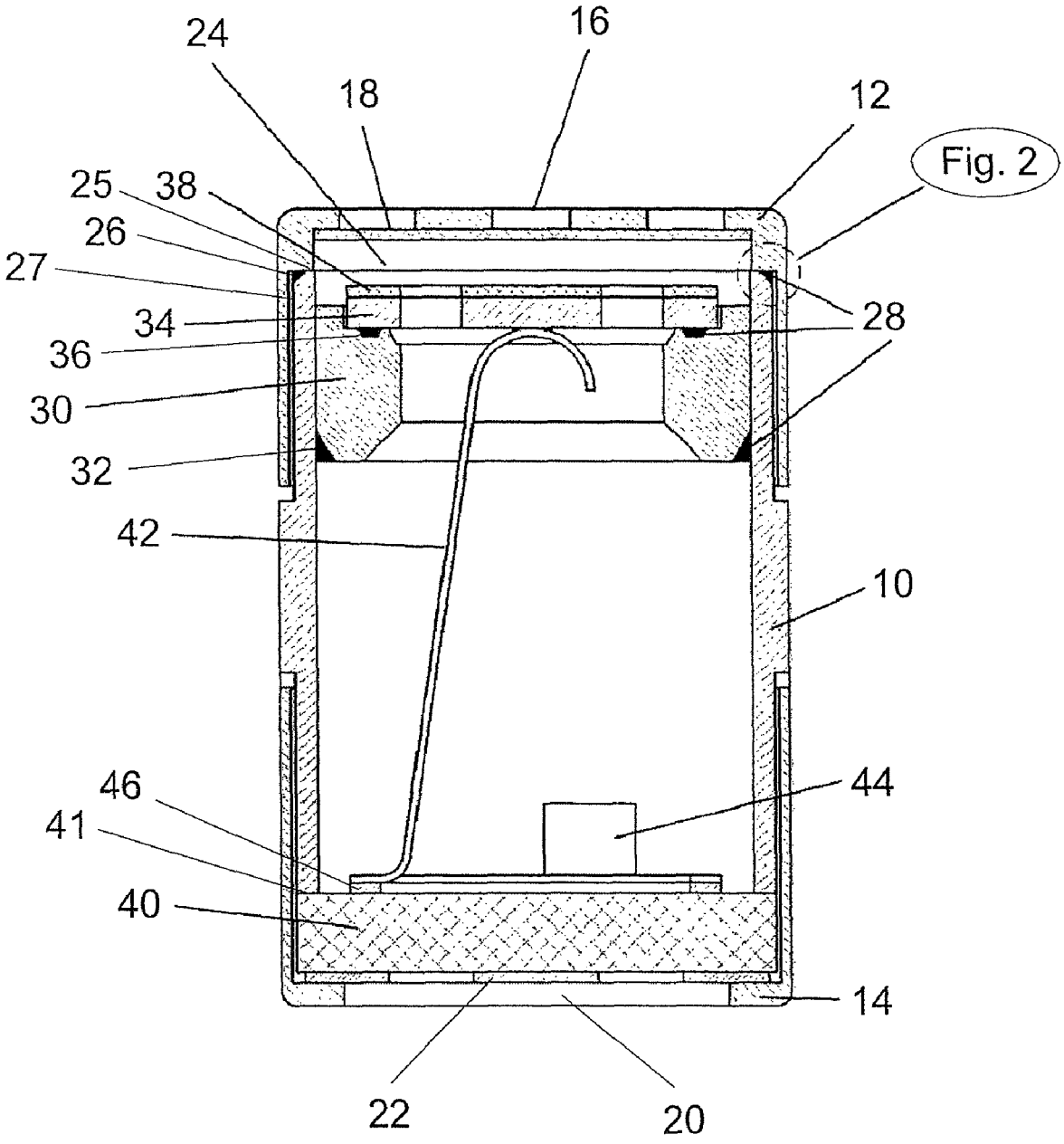
FIG. 1 shows a cross section through a first embodiment form of a condenser microphone according to the invention.

A first embodiment form of a condenser microphone according to the invention is shown in FIG. 1. The condenser microphone comprises a microphone housing 10, a microphone housing cap 12 and a closing cap 14. The microphone housing 10 is constructed as a tube which is open at both ends and contains practically the entire transducer.

The microphone housing cap 12 and the closing cap 14 are each constructed as a kind of sleeve and essentially serve as a protective and decorative covering for the microphone housing 10. Both the microphone housing cap 12 and the closing cap 14 have an inner diameter that is greater than the outer diameter of the microphone housing 10 so that the microphone housing cap 12 and closing cap 14 can both be placed over the cross-sectional opening of the microphone housing 10.

The microphone housing cap 12 has sound inlet openings 16. An acoustically permeable protective gauze 18 is arranged inside the microphone housing cap 12 behind the sound inlet openings 16. The inner diameter of the microphone housing cap 12 has a step so that the inner diameter near the sound inlet openings 16 is smaller than the inner diameter remote of the sound inlet openings 16. Only the inner diameter remote of the sound inlet openings 16 is greater than the outer diameter of the microphone housing 10 so that the microphone housing cap 12 rests by the step on a diaphragm 24 arranged on the microphone housing 10.

Figure 2:
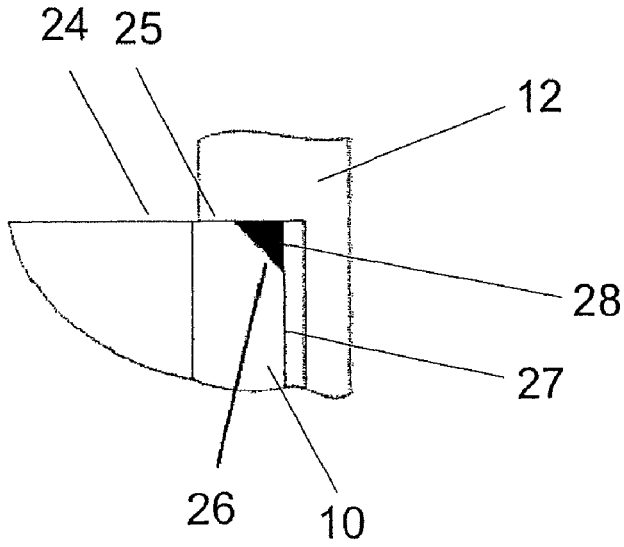
FIG. 2 shows a section from the cross section through the first embodiment form of a condenser microphone according to the invention.

The closing cap 14 has a bottom opening 20. The diaphragm 24 which has an electrically conductive coating on both sides lies on the front side 25 of the microphone housing 10 which surrounds the cross-sectional opening facing the microphone housing cap 12. The coating of the diaphragm 24 contacts the microphone housing 10. On the outer side 27 of the microphone housing 10, the front side 25 has a bevel 26 forming the outer side 27 (shown in FIG. 2). In this embodiment form, the bevel 26 has, e.g., an angle of 45° from the front side 25. An adhesive 28 which glues the underside of the diaphragm 24 to the outer side 27 of the microphone housing 10 is arranged in the bevel 26.

To fasten the diaphragm 24 to the microphone housing 10 in this way, the pretensioned diaphragm 24 is first placed on the front side 25 of the microphone housing 10 surrounding the cross-sectional opening and facing the microphone housing cap 12. Adhesive 28 is then applied to only one point between the underside of the diaphragm 24 and the outer side 27 of the microphone housing 10 and then distributes itself in the bevel 26 on the circumference. The projecting edge of the diaphragm 24 is trimmed and the remaining projecting portion, if any, is bent slightly by placing the microphone housing cap 12 on it, resulting in a contact between the coating of the diaphragm 24, e.g., a gold coating, and the inner side of the microphone housing cap 12.

An insulating part 30 which is made of plastic, for example, is arranged in the microphone housing 10. In this first embodiment form, the insulating part 30 has a bevel 32 at its side remote of the diaphragm 24 and adhesive 28 is arranged in the bevel 32 so that the insulating part 30 is glued to the inner side of the microphone housing 10.

A counter-electrode 34 is arranged on the side of the insulating part 30 facing the diaphragm 24 and is glued to the insulating part 30 by means of adhesive 28 which is arranged in a groove 36 arranged on the insulating part 30. An electret layer 38 is arranged at a short distance from the diaphragm on the side of the counter-electrode 24 facing the diaphragm 24.

For example, when producing the condenser microphone, the counter-electrode 34 (with electret layer 38) is first arranged in the microphone housing 10 so as to produce an air gap—defined as the distance between the front side of the microphone housing and the surface of the counter-electrode—of the desired value, usually on the order of 20 to 30 μm. The diaphragm 24 is then laid on the front side 25 of the microphone housing 10. Subsequently, the diaphragm is glued to the microphone housing as was described above.

A printed circuit board 40 is arranged at the cross-sectional opening of the microphone housing 10 facing the closing cap 14 in such a way that it contacts the second front side 41 of the microphone housing 10 in an insulated manner. The printed circuit board 40 is provided with an outer copper ring 50 and an inner copper surface 22 on its side facing the closing cap 14. The printed circuit board 40 contacts the closing cap 14 by the outer copper ring 50. The printed circuit board likewise has an annular copper coating 46 on the side facing the microphone housing 10.

A connecting member 42 which can be constructed, e.g., as a contact spring extends on the printed circuit board 40 within the microphone housing 10 from the counter-electrode 34 to the annular copper coating 46. A circuit arrangement 44, e.g., an integrated circuit, is arranged on the part of the connecting member 42 near the printed circuit board 40.

A spacer element for preserving the distance between the printed circuit board and the counter-electrode is not required in this embodiment form because the housing itself takes over the function of the spacer element. Alternatively, separate spacer elements can be used.

Figure 3:
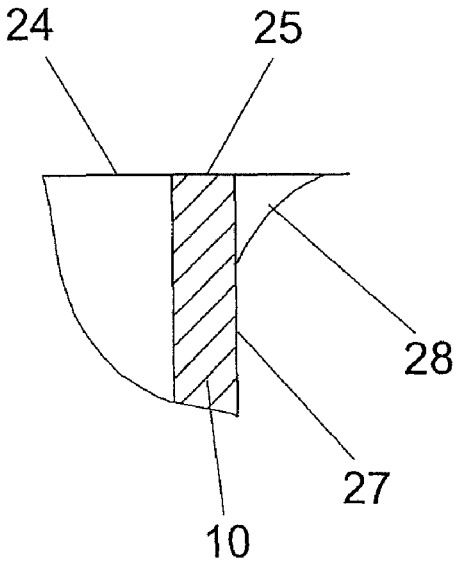
FIG. 3 shows a section from the cross section of another embodiment form of a condenser microphone according to the invention.

In an alternative embodiment form, the front side 25 of the microphone housing has no bevel. Rather, as can be seen from FIG. 3, the adhesive 28 is arranged in the angle area between the underside of the diaphragm 24 and the outer side 27 of the microphone housing 10. The projecting edge of the diaphragm 24 is again trimmed and the remaining portion having a width of, e.g., 200 μm is bent slightly by placing the microphone housing cap 12 on it, resulting in a contact between the diaphragm 24 and the microphone housing cap 12. Consequently, the gap between the microphone housing 10 and the microphone housing cap 12 is not as large in this embodiment form.

Alternatively, it is also possible that the microphone housing cap has a uniform inner diameter, that is, it does not rest on the diaphragm arranged on the microphone housing and, for example, the microphone housing has a step as spacer on which the fitted microphone housing cap rests.

In another alternative construction, it is can be provided that the insulating part carrying the counter-electrode is not connected over its full circumferential area to the microphone housing so that at least one gap serving as air outlet is formed between the edge of the insulating part and the inner wall of the microphone housing.

Figure 4:
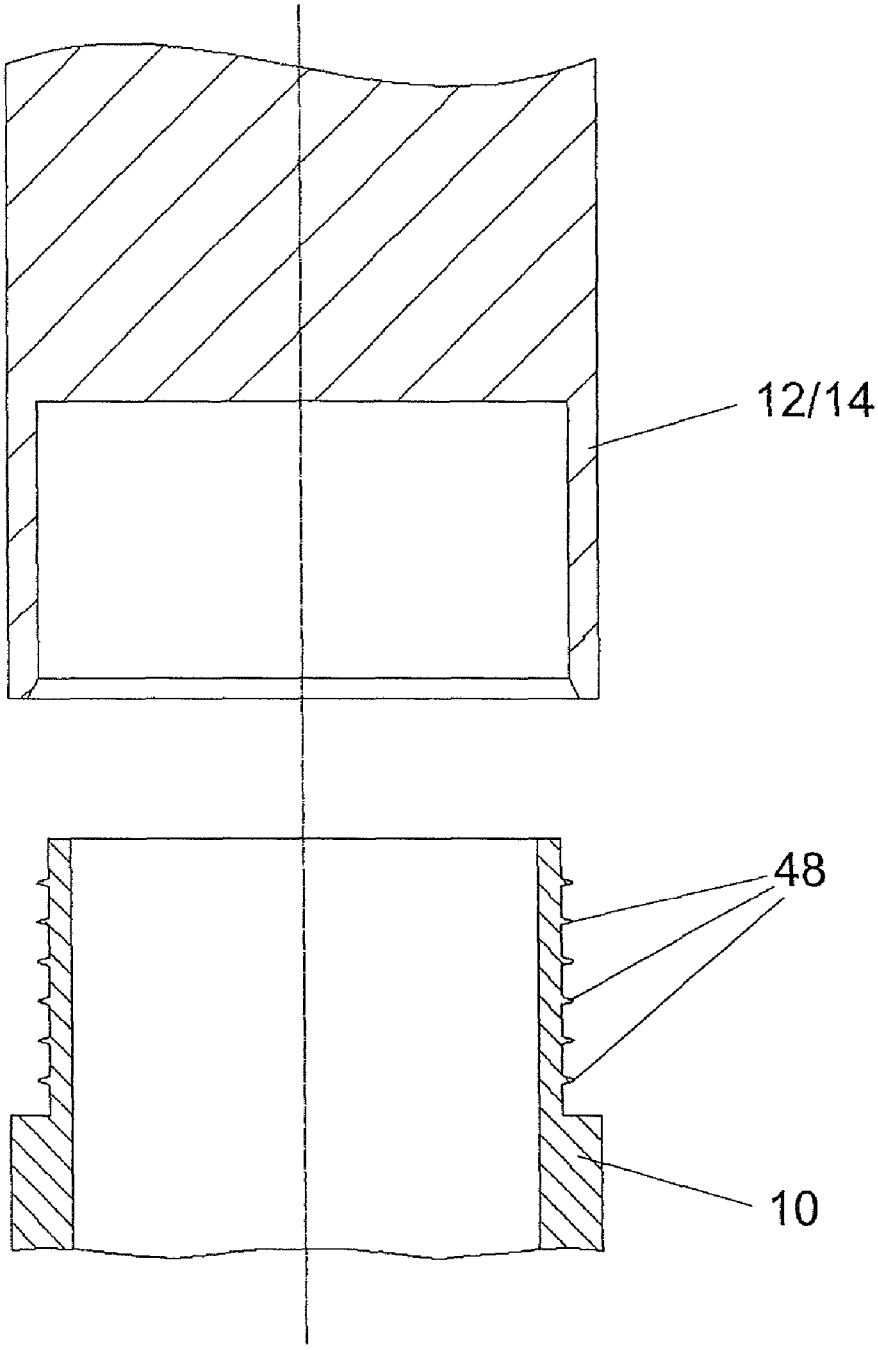
FIG. 4 is a schematic view of a closure mechanism for the microphone housing cap and/or closing cap and microphone housing.

FIG. 4 shows a possible connection of the microphone housing cap 12 and/or closing cap 14 to the microphone housing 10. The microphone housing 10 has webs 48 on its outer circumference which are formed in this instance as strips with a triangular cross section. These webs 48 can have a width of 20 to 30 μm and a depth of up to 50 μm, for example. When the microphone housing cap 12 and/or closing cap 14 are placed on the microphone housing 10, a slight pressure is applied to the strips and the microphone housing cap 12 and/or closing cap 14 can only be detached from the microphone housing 10 with great difficulty.

Accordingly, the invention proposes that the diaphragm is glued by its underside to the outer side of the microphone housing in an angle area. Therefore, the use of the customary diaphragm ring which reduces the effective usable surface of the diaphragm is obviated. It is likewise unnecessary to fold and clamp the diaphragm surface. Further, the evenness of the diaphragm surface is further improved over the prior art and the loss of diaphragm surface capable of oscillation can be further reduced. Miniature condenser microphones of higher quality can be built by means of the invention in less time and with less material. Beyond this, the invention has the advantage that the cost of rejects can be reduced because the individual assemblies can be tested before final assembly.

While the foregoing description and drawings represent the present invention, it will be obvious to those skilled in the art that various changes may be made therein without departing from the true spirit and scope of the present invention.

What is claimed is:

1. A condenser microphone comprising:

a microphone housing cap with a sound inlet opening;

a microphone housing with a front side and a cross-sectional opening facing the microphone housing cap, the front side having a first area which extends from an inner edge of the cross-sectional opening towards an outer side of the microphone housing;

a diaphragm resting along the cross-sectional opening on the front side of the microphone housing surrounding the cross-sectional opening;

a counter-electrode which faces said diaphragm and which is arranged at a short distance from the diaphragm; and wherein said diaphragm is glued to a second area of the microphone housing between the underside of the diaphragm and the outer side of the microphone housing, said second area being adjacent to the first area at the outer side of the microphone housing; and wherein the diaphragm comprises an electrically conductive coating which electrically contacts the first area of the microphone housing.

2. The condenser microphone according to claim 1;

wherein the diaphragm is glued to the microphone housing only in the angle area between the underside of the diaphragm and the outer side of the microphone housing.

3. The condenser microphone according to claim 1;

wherein the microphone housing has a bevel at the outer side of the microphone housing in the front and the diaphragm is glued to the microphone housing in the angle area between the underside of the diaphragm and the outer side of the microphone housing formed by the bevel.

4. The condenser microphone according to claim 3;

wherein the angle between the outer side formed by the bevel and the front side of the microphone housing is between 15° and 45°.

5. The condenser microphone according to claim 1;

wherein the radial width of the glued portion is in the range of 30 μm to 100 μm.

6. The condenser microphone according to claim 1;

wherein no adhesive is arranged between the front side of the microphone housing and the diaphragm or an electrically conductive coating arranged at least partially on the diaphragm.

7. The condenser microphone according to claim 1;

wherein the underside of the diaphragm is glued to the outer side of the microphone housing by means of a highly liquid adhesive.

8. The condenser microphone according to claim 1;

wherein the inner diameter of the microphone housing cap is greater than the outer diameter of the microphone housing, and the microphone housing cap is arranged over the microphone housing.

9. The condenser microphone according to claim 8;

wherein the microphone housing has concentrically arranged webs, particularly strips, on its outer circumference.

10. The condenser microphone according to claim 1;

wherein a printed circuit board with a circuit arrangement for signal processing is arranged at the microphone housing and is arranged at a distance from the counter-electrode and electrically connected to the counter-electrode by electric connecting means, the distance of the printed circuit board from the counter-electrode being defined by the microphone housing itself.

11. The condenser microphone according to claim 1;

wherein the counter-electrode is carried by an insulating part which is not connected to the microphone housing over its full circumferential area, so that at least one gap serving as an air outlet is formed between the edge of the insulating part and the inner wall of the microphone housing.

12. A method for producing a condenser microphone having a microphone housing cap with a sound inlet opening, a microphone housing with a cross-sectional opening and a front side having a first area which extends from an inner edge of the cross-sectional opening towards an outer side of the microphone housing, a diaphragm resting along the cross-sectional opening on the front side of the microphone housing surrounding the cross-sectional opening, and a counter-electrode which faces this diaphragm and which is arranged at a short distance from the diaphragm, the method comprising:

a step of gluing the diaphragm to a second area of the microphone housing between the underside of the diaphragm and the outer side of the microphone housing, said second area being adjacent to the first area at the outer side of the microphone housing;

wherein the diaphragm comprises an electrically conductive coating which electrically contacts the first area of the microphone housing.

13. The method according to claim 12, further comprising:

the steps of applying adhesive only at one point in the angle area between the underside of the diaphragm and the outer side of the microphone housing for gluing the diaphragm to the microphone housing, and allowing the adhesive to subsequently distribute itself in the angle area.

14. A condenser microphone comprising:

a cap with a sound inlet opening;

a microphone frame with a front side and a cross-sectional opening facing the cap, the front side having a first area which extends from an inner edge of the cross-sectional opening towards an outer side of the microphone frame;

a diaphragm resting along the cross-sectional opening on the front side of the microphone frame surrounding the cross-sectional opening;

a counter-electrode which faces said diaphragm and which is arranged at a short distance from the diaphragm; and wherein said diaphragm is glued to a second area of the microphone frame between the underside of the diaphragm and the outer side of the microphone frame, said second area being adjacent to the first area at the outer side of the microphone frame; and wherein the diaphragm comprises an electrically conductive coating which electrically contacts the first area of the microphone frame.

15. A method for producing a condenser microphone having a cap with a sound inlet opening, a microphone frame with a cross-sectional opening and a front side having a first area which extends from an inner edge of the cross-sectional opening towards an outer side of the microphone frame, a diaphragm resting along the cross-sectional opening on the front side of the microphone frame surrounding the cross-sectional opening, and a counter-electrode which faces this diaphragm and which is arranged at a short distance from the diaphragm, the method comprising:

a step of gluing the diaphragm to a second area of the microphone frame between the underside of the diaphragm and the outer side of the microphone frame, said second area being adjacent to the first area at the outer side of the microphone frame;

wherein the diaphragm comprises an electrically conductive coating which electrically contacts the first area of the microphone frame.

* * * * *